United States Patent [19]

Barr

[11] 4,101,264

[45] Jul. 18, 1978

[54] DRYING APPARATUS AND METHOD

[75] Inventor: Derek Julian Barr, London, England

[73] Assignee: Barr & Murphy Limited, London, England

[21] Appl. No.: 744,041

[22] Filed: Nov. 22, 1976

[30] Foreign Application Priority Data

Nov. 20, 1975 [GB] United Kingdom ..... 47886/75

[51] Int. Cl.[2] ..... F27B 15/00; F26B 3/10

[52] U.S. Cl. ..... 432/14; 34/10; 432/58; 432/72

[58] Field of Search ..... 432/14, 58, 72; 34/10; 159/4 A, 4 GC

[56] References Cited

U.S. PATENT DOCUMENTS

| | | | |
|---|---|---|---|
| 3,884,620 | 5/1975 | Rammler | 432/58 |
| 3,914,098 | 10/1975 | Kano et al. | 432/58 |

*Primary Examiner*—John J. Camby

*Attorney, Agent, or Firm*—Wenderoth, Lind & Ponack

[57] ABSTRACT

In a pneumatic dryer, a material which gives off an odorous exhaust during drying is dried in a first dryer section by a stream of hot gas, the major part of the spent gas stream being re-heated by the addition of air and burning fuel under pressure to form the said stream of hot gas. The excess spent gas in the first dryer section is passed through an incinerator to pyrolyze the odorous content of the spent gas stream, and the pyrolyzed gases are used to dry a second wet material in a second dryer section and are then passed to atmosphere. The second wet material does not give off an odorous exhaust. In a modified method a wet material which gives off an odorous exhaust when the moisture content of the material falls below a critical value during drying is dried in the second dryer section to a moisture content having a value above the critical value and is then dried to completion in the first dryer section. The heat added to incinerate the said excess spent gas from the first dryer section should be slightly in excess of what is necessary for the pyrolyzation of the odorous matter therein, and all the available heat in the hot gas stream from the incinerator should be usefully employed in drying the wet material in the second dryer section.

7 Claims, 1 Drawing Figure

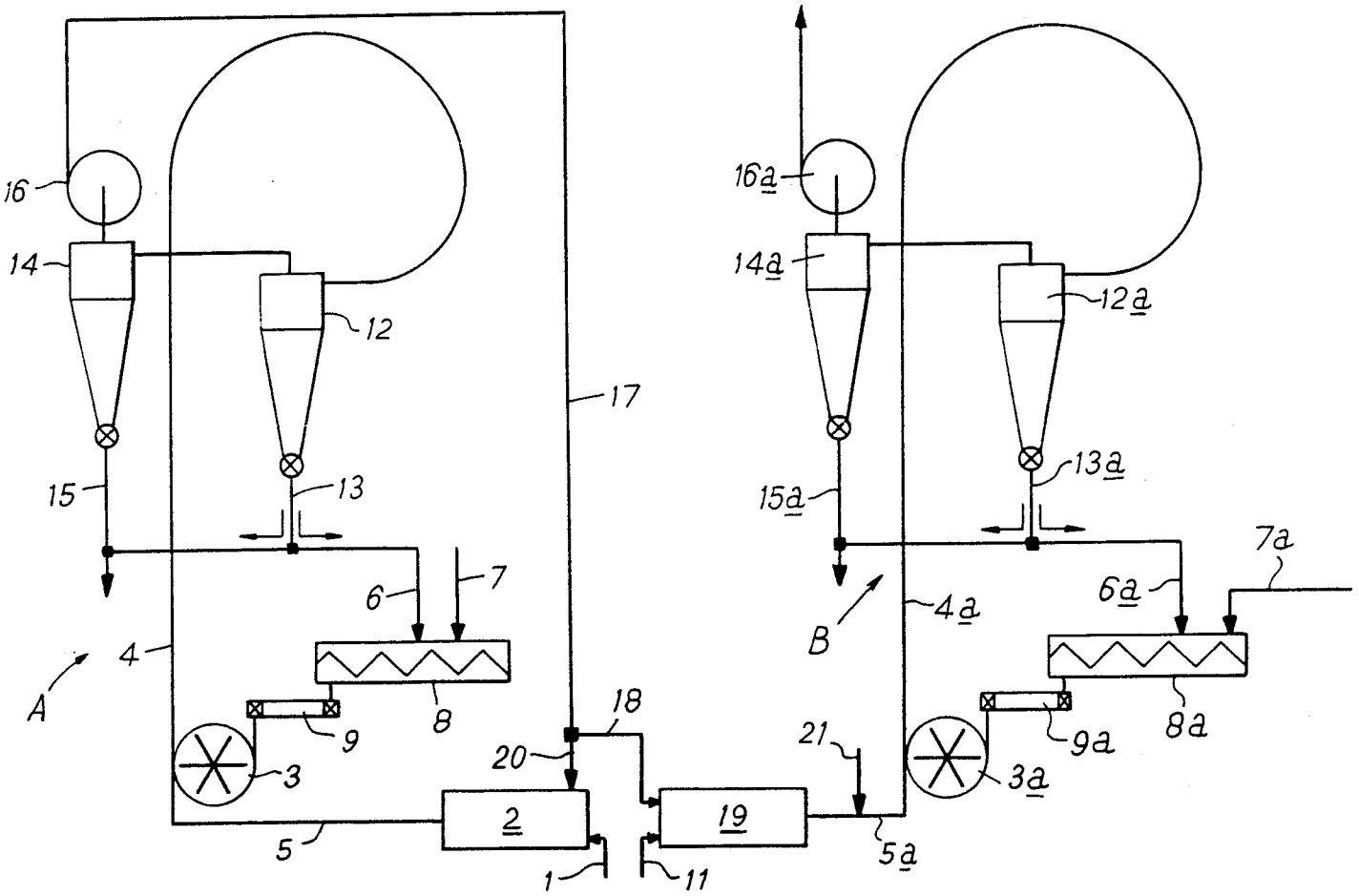
7a
8a
6a
9a
3a
12a
13a
4a
5a
B
21
19
11
16a
14a
15a
17
18
1
20
2
7
8
6
9
3
5
12
13
4
16
14
15
A

DRYING APPARATUS AND METHOD

This invention relates to the drying of wet material using a hot gas stream.

It is well known to dry heat-sensitive material in this way, for example by carrying it through a drying duct on a stream of hot gas. This hot gas stream may be conveniently produced by the combustion of hydrocarbon fuel. Hot gas must be continuously fed into the dryer and thus an equivalent quantity of exhaust gas must be exhausted from the dryer. This gas is generally exhausted direct to atmosphere, but when certain organic materials are dried, the dryer exhaust gas is odorous and objectionable. These odours have been reduced by passing the exhaust gas through a scrubber, but such scrubbers are expensive and not wholly efficient and reduce the overall thermal efficiency of the dryer.

According to one aspect of this invention there is provided a method of pneumatically drying two wet materials one of which produces an odorous exhaust during drying and the other of which produces substantially no odorous exhaust during drying, comprising using a first stream of hot gas to dry said one material in a first dryer section, re-cycling a proportion of the spent gas including entrained moisture and odorous matter through a furnace in which the spent gas is re-heated by blowing into the spent gas a flow of air in which fuel is burnt, thereby to form said first stream of hot gas, passing the excess portion of the spent first stream of gas and the entrained moisture and odorous matter through an incinerator to pyrolyse the odorous matter in said excess portion, and passing the hot gaseous products from the incinerator through the second wet material in a second dryer section and thence to atmosphere.

The invention also provides a method of pneumatically drying a material which does not produce an odorous exhaust so long as the moisture content of the material is kept above a critical value during drying but which does produce an odorous exhaust when the moisture content falls below the critical value during drying, in which method a stream of hot gas is used for the final drying of the material in a first dryer section, a major part of the spent gas stream being re-cycled after being augmented and heated by the products of combustion of predetermined quantities of air and fuel fed into the said major part of the spent gas stream under pressure, the excess spent gas being subjected to incineration to pyrolyse its entrained odorous content and the incinerated hot gases being used in a second dryer section for pneumatically pre-drying the material from its initial moisture content equal to or above the critical value and being then passed to atmosphere.

In carrying out the method the total weight of said excess portion of the spent first gas stream less the weight of the entrained odorous matter and water vapour removed from the wet material in the first dryer section is counterbalanced by the weight of fuel and combustion air added to said major proportion for reheating purposes, for example in a heating furnace. The said excess portion of spent gas from the first dryer section is introduced into the combustion chamber of an incinerating furnace where it is raised to an elevated temperature, preferably by burning in the gas a mixture of hydrocarbon fuel and air. The hot gases issuing from the incinerator, which gases may then be cooled to a predetermined temperature for example by admixture with fresh air, constitute the heat input to the second dryer section. For efficient operation the heat input to the incinerator furnace should preferably be slightly in excess of the heat requirement necessary for ensuring efficient incineration of the odours in the excess spent gas overflowing from the first dryer section, and all the fuel required for incineration of odours from the spent gas tapped from the first gas stream should be usefully employed in drying the wet material in the second dryer section, so that the system as a whole is in balance.

The invention also provides drying apparatus comprising first and second dryer sections for respectively drying first and second wet materials, said first dryer section including a drying duct, means for feeding wet material into the drying duct, means for forcing a first stream of hot gas through the drying duct to convey the first wet material along the duct and to dry the material, separating means for separating from the spent first gas stream the material which has been conveyed along and dried in the first duct, an exhaust duct for the spent first gas stream, a furnace connected to receive spent gas from the exhaust duct and adapted to blow into the spent gas air in which fuel is burnt thereby to re-heat the gas for re-cycling through said drying duct, an incinerator connected to receive from the exhaust duct the excess flow of the spent first gas stream including entrained water vapour and odorous matter resulting from the drying of the wet material said incinerator being adapted to pyrolyse the odorous matter, the second dryer section being connected to receive the hot gaseous products the incinerator for drying said second wet material and to pass the spent gaseous products to atmosphere.

In order that the invention may be more readily understood, one apparatus and method according to the invention will now be described wth reference to the accompanying diagrammatic drawing of a drying apparatus.

The apparatus shown in the drawing is for drying a liquor which is a by-product in a grain processing operation and which has a high protein content. To facilitate the drying the liquor is mixed with a fibrous material which is usually derived from the same grain material and which has a low protein content.

Referring to the drawing, apparatus comprises first and second dryer sections A and B. In the first dryer section the fibrous material and liquor are deposited continuously into a mixer 8 through an inlet 7 thereof. A material having a higher solids content is also fed continuously into the mixer through an inlet 6 and is mixed with the liquor and fibrous material. The resulting mixture is fed by a suitable feeding device 9 into a disintegrator 3 which introduces it at high velocity into a vertical section of a drying duct 4. A furnace 2 at the upstream end of duct 5 burns a hydrocarbon fuel in air and the products of combustion are mixed with recycled spent gas to produce a first hot gas stream which is drawn through duct 5 into and through duct 4. The combustion air is blown into the heater through a conduit 1. The wet mixture fed into the duct 4 by disintegrator 3 is conveyed along the duct 4 and dried by this hot gas stream. The drying mixture passes from duct 4 into a first cyclone separator 12 which removes from the spent gas stream part of the dried material and passes it to an outlet chute 13. The remainder of the dried material is separated from the spent gas stream in a secondary cyclone separator 14 and is discharged through an outlet chute 15. The spent gas stream passes then through a powerful circulating fan 16 which causes the spent gas stream to flow through a duct 17.

The dried product discharged from the separator 12 through the chute 13, is divided into two portions, one of which is returned to the mixer 8 to form the material previously mentioned as added through inlet 6, the other portion being discharged as finished product together with the product discharged from the secondary cyclone 14 by way of chute 15.

Most of the spent gas is returned to air heater 2 through a conduit 20 and is thus re-cycled in a closed circuit, but the operation of the fan 16 causes the pressure to be higher in duct 17 than in the drying duct 4, and since air and fuel under pressure are blown into the furnace 2 for combustion, there is an excess of gas in the circuit. This excess gas is tapped off through a pipe 18. The mass flow of this excess part corresponds to the mass flow of fuel and combustion air through inlet 1 into furnace 2, plus the water evaporated from the product dried in the first drying stage, plus any leaks of fresh air into the first stage dryer. This tapped-off gas flow through the pipe 18 is fed into an incinerator 19, where fuel is burnt in combustion ar entering through pipe 11 and heats the tapped-off gas flow to a predetermined high temperature for a predetermined time so that the odorous components in the gas are pyrolysed. It is found that a temperature of 650° C, with a residence time of half a second in the combustion chamber, is sufficient to destroy most odours encountered in drying. Fresh air fed through a conduit 21 is mixed with the outlet gases from the combustion chamber to form a second stream of hot gas at a temperature suitable for drying operations. This second hot gas stream is used to dry a wet material in the second dryer section B which in the illustrated construction comprises parts 3*a* to 16*a* corresonding respectively to the parts 3 to 16 of the first dryer section. However, in the second dryer section the spent gas stream is exhausted to atmosphere by the fan 16*a* and consequently it is necessary that the drying carried out in the second dryer section should not produce air pollution.

The recirculation of the spent drying medium through the furnace 2 causes the first hot gas stream to have a low oxygen content and in consequence there is little oxidation of the material during the drying process and very little fire risk despite the high gas temperatures. It is preferred that the hot gas stream flowing along the drying duct 4 should have a high moisture content, for example 30 to 40%, becuase it is found that although the initial rate of drying is slower than if the gas is dryer there is less tendency for scorching of the material and a more effective transfer of moisture from the interior to the external surface of the grains of material and hence more effective drying.

In an alternative form of the apparatus, the parts 3*a* to 16*a* of the second dryer section are replaced by a plurality of rotary dryers arranged in parallel each comprising a rotary drum through which a hot gas stream is passed axially, the material to be dried being deposited in the drum at its upstream end so that the material tumbles round the drum and across the hot gas stream and eventually falls or is removed from the other end of the drum. In this arrangement the second hot gas stream is shared between the rotary dryers.

In any of these arrangements the dried material forming the output of the second dryer section may be passed to the first dryer section for further drying.

In another arrangement in which the apparatus is used to produce cattle feed or the like from corn steep liquor and corn fibre, both of which are by-products in the corn starch industry, corn fibre dried in a group of rotary dryers constituting the second dryer section is mixed with steep liquor and fed into the first dryer section through the inlet 7 to mixer 8, the corn fibre serving as a carrier for the steep liquor, which is rich in protein. In one such arrangement the group of rotary dryers is used to dry corn fibre from 65% initial moisture content to 20% moisture content, at an output rate of 23,000 lb/hr. This quantity of 23,000 lb/hr of fibre with 20% moisture content is mixed with 33,000 lb corn steep liquor of 55% moisture content and fed into mixer 8 through inlet 7 together with 44,000 lb dried product fed into the mixer from the cyclone separator 12. Thus the mixer 8 feeds a total of 100,000 lb/hr wet mixtiure into the first drying duct 4, where 19,000 lb/hr moisture is evaporated. In order to achieve this, 120,000 lb/hr drying medium is passed through the duct 4, the temperature at the outlet of the furnace 2 being approximately 1000° F (538° C). In the drying duct 4 the 19,000 lb/hr water which is evaporated reduces the gas temperature to approximately 300° F (150° C). The 120,000 lb/hr gas plus the 19,000 lb/hr evaporated water enters the cyclone separator 12 where the bulk of the dried product is separated 44,000 lb/hr being returned to the mixer 8 whilst 37,000 lb/hr finished product is discharged at 15, including the product separated in separator 14. Of the 139,000 lb/hr drying medium and evaporated water returning along duct 17 88,000 lb/hr are returned to the furnace 2 and are heated by mixture with products of combustion of natural gas totalling 32,000 lb/hr to maintain the total quantity of 120,000 lb circulating in the first dryer section. 51,000 lb/hr of the odorous mixture of drying medium and evaporated water is tapped from duct 17 and carried to the incinerator 19, where it is heated to a temperature of 1300° F (705° C) to burn off the odorous material and afterwards diluted with fresh air entering through pipe 21. The reslting hot gas mixture is used in the group of rotary dryers to pre-dry the corn fibre, which does not produce any odour, and the exhaust gas is passed to atmosphere.

If the system has no inward leaks, the mixture tapped from return duct 17 consists of 32,000 lb/hr products of combustion plus 19,000 lb/hr water vapour. Assuming that the products of combustion contain 10% moisture, the total moisture content of the tapped mixture is approximately 22,000 lb/hr together with 29,000 lb/hr non-condensable gas, corresponding to a humidity of approximately 0.75 lb water vapor per lb dry gas.

The method according to the invention can provide a solution to air pollution problems in many cases where there is the possibility of operating a polluting drying process and a non-polluting drying process in the same location. Another example in the wet corn milling industry is the drying of corn gluten feed in a single operation in the first dryer section, incinerating the exhaust in a second dryer section operating to dry corn protein. Another example is the drying of distillers light grains in the second dryer section as a clean drying operation with distillers solubles dried on the light grain carrier (to make distillers dark grains) in the first dryer section, all the exhaust from the first dryer section being incinerated. However, the method is not limited to vegetable processing applications and may be useful in animal product and chemical processing applications.

It will be understood that the drying functions of both the first and second dryer sections may be carried out by other types of dryer using hot gas with te same overall result, the same re-cycling of a portion of the gas stream in the first dryer section being carried out.

I claim:

1. A method of pneumatically drying two wet materials, the first of which produces an odorous exhaust during drying and the second of which products substantially no odorous exhaust during drying, using a first dryer section, a second dryer section, a furnace and an incinerator, which method comprises drying said first wet material in the first dryer section by means of a first stream of hot gas, re-cycling a portion of spent gas, including entrained moisture and odorous matter, from the first dryer section through the furnace and re-heating said portion of spent gas in the furnace by blowing into said portion of spent gas a flow of air in which fuel is burnt, thereby forming the first stream of hot gas, passing the entire remaining portion of the spent gas, including entrained moisture and odorous matter, through the incinerator to pyrolyse the odorous matter in said remaining portion, and passing hot gaseous products from the incinerator through said second wet material in the second dryer section and then into the atmosphere.

2. A method as claimed in claim 1, which further comprises mixing a portion of the dried material which has passed through the first dryer section with the first wet material and passing the resultant mixture through the first dryer section.

3. A method of pneumatically drying a material which does not produce an odorous exhaust when the moisture content of the material is maintained above a critical value during drying, but which does produce an odorous exhaust when the moisture content of the material falls below the critical value during drying, using a first dryer section, a second dryer section, a furnace, and an incinerator, which method comprises partially drying the material to a moisture content equal to or above the critical value in the second dryer section by means of hot gases from the incinerator, passing the resultant spent gases from the second dryer section into the atmosphere, transferring the thus partially dried material to the first dryer section, further drying the partially dried material in the first dryer section by means of a stream of hot gas, augmenting and re-heating a major portion of the spent gas stream exhausted from the first dryer section by adding, under pressure, products of combustion of predtermined quantities of air and fuel to said major portion in said furnace, recycling the augmented and re-heated spent gas to the first dryer section, and subjecting the entire remaning portion of said spent gas stream to incineration in said incinerator to pyrolyse odorous matter contained in said remaining portion and to produce said hot gases which are used in partially drying the material in said second dryer section.

4. A method as claimed in claim 3, which further comprises reducing the temperature of the hot gaseous products from the incinerator by adding air to the hot gaseous products.

5. Drying apparatus comprising first and second dryer sections for respectively drying first and second weet materials, said first dryer section including a drying duct, first feeding means operatively connected to the drying duct for feeding said first wet material into the drying duct, means operatively connected to the drying duct for forcing a first stream of hot gas through the drying duct to convey the first wet material along the drying duct and to dry the first wet material, separating means operatively connected to the drying duct for receiving the dried material and spent gas from the drying duct, said separating means being adapted to separate the dried material from the spent gas, an exhaust duct operatively connected to the separating means for receiving the spent gas from the separating means, a furnace operatively connected to the exhaust duct for receiving a portion of the spent gas from the exhaust duct, said furnace being adapted to permit blowing into said portion of spent gas air in which fuel is burnt, thereby to re-heat the spent gas for re-cycling the spent gas through sad drying duct, an incinerator operatively connected to the exhaust duct for receiving from the exhaust duct the entire remaining portion of the spent gas, including entrained water vapor and odorous matter resulting from the drying of the first wet material, said incinerator being adapted to pyrolyse the odorous matter, and the second dryer section being operatively connected to the incinerator for receiving hot gaseous products from the incinerator to dry said second wet material and for passing the resultant spent gaseous products into the atmosphere.

6. Drying apparatus as claimed in claim 5, further comprising means operatively connected between the incinerator and the second drying means for reducing the temperature of the hot gaseous products leaving the incinerator before said products are employed to dry the second wet material.

7. Drying apparatus as claimed in claim 6, further comprising mixing means operatively connected between the drying duct and the first feeding means for mixing a portion of the dried material separated from the spent gas with the first wet material which is to be fed into said drying duct.

* * * * *